United States Patent [19]

Wright

[11] 4,085,778

[45] Apr. 25, 1978

[54] PACKAGING MACHINE

[75] Inventor: Donald R. Wright, Midland, Mich.

[73] Assignee: The Kartridg Pak Company, Davenport, Iowa

[21] Appl. No.: 784,730

[22] Filed: Apr. 5, 1977

[51] Int. Cl.[2] ..... B65B 13/28; B65B 51/04; B26D 5/08

[52] U.S. Cl. ..... 140/93 A; 53/138 A; 53/198 A; 83/560; 83/583; 83/640

[58] Field of Search ..... 53/138 A, 198 A; 83/560, 583, 640, 641, 700; 140/93 A, 93.2, 93.6, 140

[56] References Cited

U.S. PATENT DOCUMENTS

| | | | |
|---|---|---|---|
| 1,216,315 | 2/1917 | Heckman | 83/560 |
| 1,650,841 | 11/1927 | Lewis | 83/560 |
| 3,795,083 | 3/1974 | Wells | 53/138 A |

*Primary Examiner*—E. M. Combs

*Attorney, Agent, or Firm*—Lockwood, Dewey, Zickert & Alex

[57] ABSTRACT

A packaging machine is provided in which wire is fed for cutting into predetermined lengths for subsequent formation into U-shaped clips for clinching about a constricted product filled tube. It includes means for varying the length of the cut off portion by adjusting the position of a cut off knife along the wire against the biasing action of a cooperating wire receiving member or cut off round.

6 Claims, 5 Drawing Figures

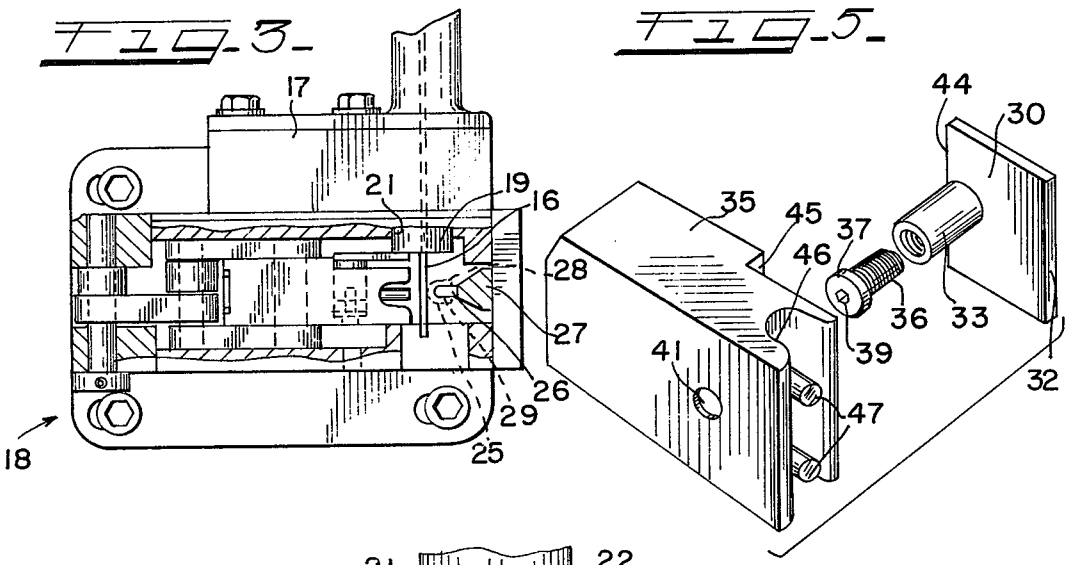
FIG. 5
FIG. 3
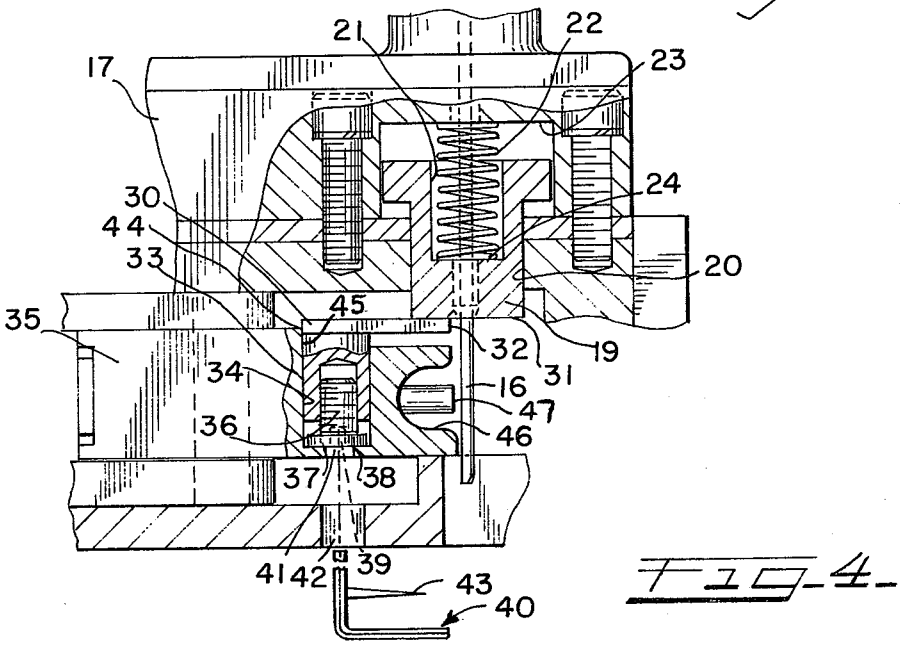
FIG. 4
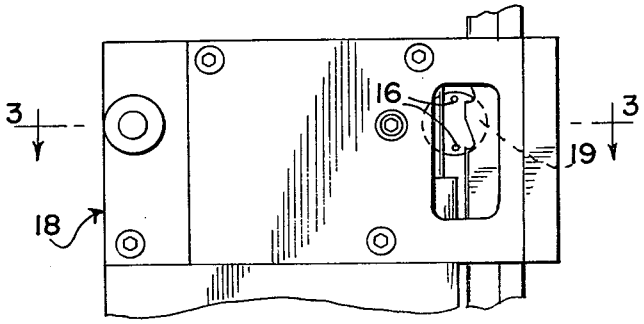
FIG. 2
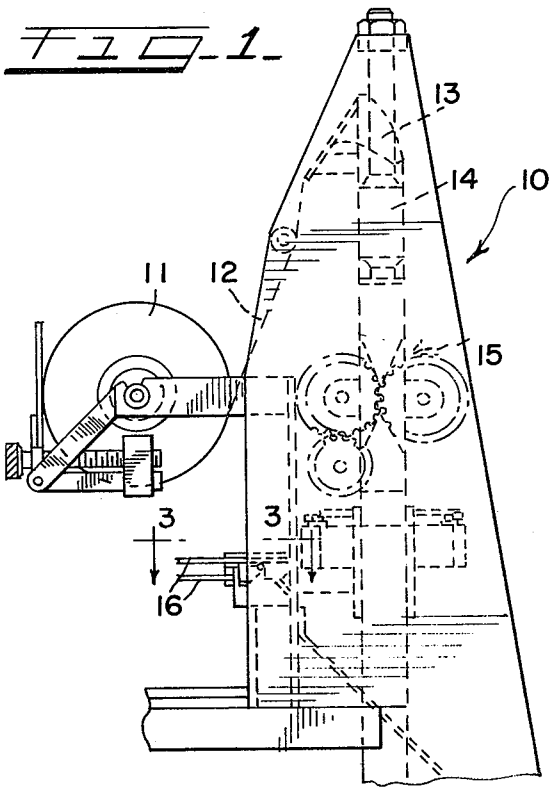
FIG. 1

PACKAGING MACHINE

This invention relates, generally, to packaging machines, known in the art as chub machines, and constitutes an improvement over the packaging machines disclosed in U.S. Pat. Nos. 2,831,302, issued Apr. 22, 1958 and 3,380,226, issued Apr. 30, 1968.

In the prior art, chub machines, in order to obtain a wire length suitable to function well as a tight wrap-around or butt type wire clip, it is necessary to purchase a large number of precision made forming plates or cut off blocks very close in size to each other. This was expensive. Also, the services of a skilled mechanic were required to change the clip length to accommodate different packaging conditions. Heretofore, the clip legs were adjusted in finite steps as determined by the dimensions of the precision made forming plates or cut off blocks. The width of the cut off block determined the length of the inner clip leg while the length of the wire feed determined the length of the outer leg. The adjustment of the wire feed length was uncalibrated and required a cut and try method to achieve balanced leg lengths when changing sizes. This also required the services of a skilled mechanic.

Among the objects of this invention are: To provide in a chub machine means within the skill of an ordinary operator for adjusting it for making and using clips of different lengths; and within a limited range, to provide for infinitely varying the length of the inner clip leg.

In the drawings:

FIG. 1 is a partial side elevational view of a packaging machine in which this invention is embodied. It corresponds generally to FIG. 1 of each of the above patents.

FIG. 2 is a view, in side elevation, of a portion of the wire cut-off assembly that houses the wire receiving member and the clip forming plate that carries the knife blade.

FIG. 3 is a horizontal sectional view taken generally along line 3—3 of FIG. 2 and shows the arrangement of the slidable wire receiving member or cut off round and the cooperating adjustable knife blade carried by the slidable clip forming plate.

FIG. 4 is a view, at an enlarged scale and with certain parts shown in section, of the wire receiving member and the clip forming plate that carries the knife blade.

FIG. 5 is a perspective view of the knife blade, adjusting screw and clip forming plate.

Referring now to FIG. 1 of the drawing, it will be observed that reference character 10 designates, generally, a packaging machine in which the present invention can be embodied. The packaging machine 10 can be constructed as described in the above patents and commercial embodiments are well known in the art. Accordingly, only a limited description thereof will be set forth herein. A reel 11 is suitably mounted on the machine 10 from which a plastic film 12 can be withdrawn and guided over a tube forming die 13 which directs it around a stuffing mandrel 14 through which a flowable product is directed into the formed and sealed tube as it moves downwardly through the machine 10 as drawn by a tube feeding mechanism that is indicated, generally, at 15.

The adjacent ends of formed packages of the flowable material are sealed by means of wire clips which are formed from two wires 16 that are suitably fed into a block 17 carried by the machine 10. The block 17 is suitably mounted on a frame 18 as shown in FIG. 3.

The two wires 16 are fed through the block 17 and through a wire receiving member or cut off round 19. They are located at diametrically opposite positions near the periphery of the member 19.

It is desirable to provide for varying the length of the two wires that are cut off in order to accommodate different packaging conditions. For this purpose, the wire receiving member 19 is slidably mounted in a cylindrical opening 20 that extends through a portion of the block 17. The member 19 has a central cylindrical cavity 21 for receiving a coil compression spring 22. One end of the spring 22 reacts against a fixed wall 23 of the block 17 while the other end reacts against a bottom wall 24 of the cavity 21.

As shown in FIG. 3, a cut off length of the wire 16 is arranged to be formed about a nose 26 of an anvil that is carried by a vertically reciprocable rod 27 which is operated in timed relation by the machine 10 as described in the patents above referred to. The wire clip 25 has an inner leg 28 and an outer leg 29.

In order to cut off lengths of the wire 16 there is provided a rectangular knife blade 30 which is arranged to be moved over the face 31 of the wire receiving member or cut off round 19. The blade 30 has a rectangular wire shearing edge 32 which is arranged to sever the wires 16 as they emerge from the wire receiving member or cut off round 19.

With a view to varying the lengths of the portions of the wire 16 that are cut off, the position of the knife blade 30 is varied in cooperation with the wire receiving member 19 as biased by the coil compression spring 22. For this purpose, an internally threaded sleeve 33 extends from the knife blade 30, as shown more clearly in FIG. 5. It is located in a cylindrical opening 34 that is formed in a clip forming plate 35. It will be understood that the clip forming plate 35 is slidably mounted in the frame 18 for movement transversly of the wires 16. A threaded stud 36 is screwed into the sleeve 33, as shown in FIG. 4, and it has a head 37 which is arranged to bear against a bottom wall 38 of the cylindrical opening 34. The head 37 is provided with a socket 39 that is arranged to receive an Allen wrench which is indicated, generally, at 40. The Allen wrench is arranged to be inserted through an opening 41 in the bottom wall 38 and through an aligned opening 42 in the frame 18. A pointer 43, carried by the Allen wrench 40, can be moved with respect to a fixed scale (not shown) to provide for an infinitely variable positioning of the knife blade 30 and, in turn, the wire receiving member or cut off round 19, through a limited extent for varying the lengths that are cut off from the wire 16. The vertical edge 44 on the blade 30 butts up against a shoulder 45 which is carried by the plate 35. This arrangement serves to hold the knife blade 30 in proper relation to the clip forming plate 35. It will be appreciated that when the stud 36 is backed out of the sleeve 33, the blade 32 is moved away from the plate 35 and the cut off round 19 is forced rearwardly resulting in an increase in the length of the wire that is cut off. Conversely, when the stud 36 is screwed into sleeve 33 the blade 30 comes closer to the support plate 35 under the force of the spring 22 and the cut off round 19 is allowed to project a like amount resulting in shorter lengths of wire being cut off.

The wire clip 25 is formed in known manner about the nose of the anvil 26 by the clip forming plate 35 when its groove 46 is moved forwardly to cause the legs 28 and 29 to be formed around the nose of the anvil 26. Ejector pins 47 serve to displace the formed clips 25 from the groove 46 during a succeeding cycle in the operation of the machine 10.

I claim:

1. In a machine in which wire is fed and cut into pieces of predetermined lengths and the pieces formed into U-shaped clips for clinching about a constricted product-filled tube, means for varying the lengths of the cut off wire pieces, comprising: a frame or housing; a wire receiving member slidably mounted on said frame and protruding through a guide opening in said frame and having a wire cut off surface on its projecting end, said member being slidable in said guide opening along an axis; means for feeding wire through said member as as to emerge through said wire cut off surface; a clip forming plate reciprocably mounted on said frame for forming cut off pieces of wire into U-shaped clips, said plate being reciprocable in a direction transverse to said axis; a knife blade mounted on said plate and with a wire shearing edge having transverse sliding engagement with said wire cut off surface, said knife blade being laterally movable with respect to said plate in a direction parallel to said axis; means for adjustably positioning one of said wire receiving member and said knife blade; and, spring means maintaining said wire shearing edge and said wire cut off surface in wire cutting engagement as said wire receiving member is moved on said axis and said knife blade is moved with respect to said plate in a direction paralleling said axis.

2. In a machine according to claim 1 wherein said wire receiving member is cylindrical in configuration and is movable in a cylindrical guide opening in said frame.

3. In a machine according to claim 1 wherein said spring means reacts between said frame and said wire receiving member to bias the latter toward said knife blade.

4. In a machine according to claim 1 wherein said positioning means reacts between said plate and said knife blade to move the latter toward or away from said plate.

5. In a machine according to claim 4 wherein said adjusting means comprises an internally threaded sleeve attached to said knife blade and extending into said clip forming plate, and a stud screwed into said threaded sleeve and reacting against said clip forming plate whereby rotation of said stud moves said knife blade along said wire to vary said length.

6. In a machine according to claim 5 wherein said stud has a socket in one end for receiving a wrench for rotating said stud.

* * * * *